US007776131B2

(12) United States Patent
Shoji et al.

(10) Patent No.: US 7,776,131 B2
(45) Date of Patent: Aug. 17, 2010

(54) MANUFACTURING METHOD FOR OXIDE DISPERSED ALLOY

(75) Inventors: Toru Shoji, Hiratsuka (JP); Seiichiro Tanaka, Tokyo (JP); Seiji Takeishi, Isehara (JP); Hideo Segawa, Isehara (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 402 days.

(21) Appl. No.: 10/582,536

(22) PCT Filed: Aug. 22, 2005

(86) PCT No.: PCT/JP2005/015188

§ 371 (c)(1),
(2), (4) Date: Jun. 9, 2006

(87) PCT Pub. No.: WO2006/022212

PCT Pub. Date: Mar. 2, 2006

(65) Prior Publication Data

US 2008/0279711 A1 Nov. 13, 2008

(30) Foreign Application Priority Data

Aug. 23, 2004 (JP) ..... 2004-242538

(51) Int. Cl.
*B22F 9/04* (2006.01)

(52) U.S. Cl. ..... 75/352; 419/20

(58) Field of Classification Search ..... None
See application file for complete search history.

(56) References Cited

U.S. PATENT DOCUMENTS 3,709,667 A * 1/1973 Selman et al. ..... 75/234
3,741,748 A * 6/1973 Fustukian et al. ..... 75/252
4,315,777 A * 2/1982 Nadkarni et al. ..... 75/232
5,007,476 A * 4/1991 Newkirk et al. ..... 164/97
5,915,160 A * 6/1999 Krotz et al. ..... 419/20

FOREIGN PATENT DOCUMENTS

| | | |
|---|---|---|
| JP | 05-195002 | 8/1993 |
| JP | 08-134511 | 5/1996 |
| JP | 09-031567 | 2/1997 |

OTHER PUBLICATIONS

"High Energy Ball Milling", http://www.unionprocess.com/ball_mills.html, by Union Process Inc., Printout date: Sep. 10, 2009.

* cited by examiner

*Primary Examiner*—George Wyszomierski
(74) *Attorney, Agent, or Firm*—Roberts & Roberts, LLP

(57) ABSTRACT

A manufacturing method for an oxide-dispersed alloy wherein dispersed particles consisting of oxides of one or two or more additive metals are dispersed in a matrix metal, comprising the steps of (a) manufacturing alloy powder or an alloy wire rod consisting of the matrix metal and the additive metal; (b) oxidizing the additive metal in the alloy powder by water to form dispersed particles by introducing the alloy powder or alloy wire rod into a high-energy ball mill with water and by making agitation; and (c) moldedly solidifying the alloy powder or alloy wire rod after oxidation. The present invention is especially useful in manufacturing oxide-dispersed alloys in which the free energy of oxide formation of the matrix metal is higher than water standard free energy of formation, and the free energy of oxide formation of the additive metal is lower than water standard free energy of formation.

8 Claims, 3 Drawing Sheets

MANUFACTURING METHOD FOR OXIDE DISPERSED ALLOY

TECHNICAL FIELD

The present invention relates to a manufacturing method for an oxide-dispersed alloy, which is a dispersion strengthened alloy. More particularly, it relates to a manufacturing method for an oxide-dispersed alloy in which fine dispersed particles are dispersed uniformly.

BACKGROUND ART

Dispersion strengthening is a well-known strengthening method for metallic materials, in which dispersed particles consisting of carbide, nitride, or oxide of a metal are dispersed in another metal matrix, by which the mechanical properties of matrix metal are improved by the function of dispersed particles.

Oxide-dispersed alloys to which a metallic oxide is applied as dispersed particles have many kinds, and are in widespread use. For example, an alloy in which the oxide particles of a metal such as zirconium are dispersed in platinum, which is a matrix metal, is called strengthened platinum, and is used as a material in a high-temperature region, for example, as a construction material for a glass manufacturing apparatus because of its improved high-temperature creep strength.

Many manufacturing methods for an oxide-dispersed alloy are basically based on powder metallurgy. Generally, alloy powder in a state in which the oxide of additive metal is dispersed in a matrix metal is manufactured, and the alloy powder is moldedly solidified, for example, by sintering, and is further worked as necessary. As a method of introducing an oxide to manufacture alloy powder in which dispersed particles are dispersed in a matrix metal, several methods are available.

As a means for introducing the oxide of additive metal into a matrix metal, there is available a method in which matrix metal powder and powder of additive metal oxide are introduced into a high-energy ball mill such as attritor and are agitated to mechanically alloy the matrix metal and the oxide (mechanical alloying), by which alloy powder in which an oxide is dispersed in a matrix metal is formed.

Also, as another method of introducing an oxide, powder consisting of an alloy (solid solution) of a matrix metal and an additive metal is first manufactured, thus manufactured powder is heated at a high temperature in an oxidizing atmosphere, and the additive metal in the alloy is oxidized (internal oxidation), by which powder in which an oxide is dispersed in the matrix metal can be manufactured. In the case of the above-described strengthened platinum, alloy powder is often manufactured by this internal oxidation method. For example, Patent Document 1 disclosed by the applicant of this invention discloses a manufacturing method for strengthened platinum, in which internal oxidation processing and wet grinding processing are combined.

Patent Document 1: Japanese Patent Application Laid-Open No. 8-134511

For the dispersion strengthened alloy, in order to sufficiently demonstrate the strengthening mechanism while properties other than strength are not impaired, it is important to control the quantity of dispersed particles and the dispersion state. An alloy in which the quantity of dispersed particles is at a necessary minimum, and fine dispersed particles are dispersed uniformly in a state of high dispersion is an ideal alloy. For example, if oxide particles are increased beyond necessity, not only the properties such as weldability are degraded but also the strength properties are sometimes affected adversely.

In the above-described methods, an ideal dispersion state cannot necessarily be realized. In the method in which a matrix metal and the oxide of additive metal are mixed mechanically, the oxide is not always dispersed uniformly because the mixing is basically mixing of a solid and a solid. Also, it is necessary to manufacture powder of additive metal oxide, but this manufacture itself is difficult to do.

On the other hand, in the method in which alloy powder is internally oxidized, an oxide can be dispersed uniformly by oxidizing a uniform solid solution, which is an advantage. However, because of processing performed in a high-temperature atmosphere, there is a fear of growth of the yielded oxide. Also, in the method using internal oxidation, oxygen diffusion occurs preferentially at the grain boundary at the time of oxidation, and the additive metal diffuses to the grain boundary to yield an oxide, so that an ideal degree of dispersion cannot sometimes be obtained. Further, crystal grain growth of a matrix metal phase is liable to take place, and the grain boundary area decreases, so that the degree of dispersion of dispersed particles at the time of internal oxidation tends to decrease easily. Therefore, an alloy having a high strength is not always obtained finally.

The present invention has been made based on the above background, and accordingly an object thereof is to provide a manufacturing method for an oxide dispersed alloy by which an alloy can be manufactured in which oxide particles are dispersed in an ideal state.

DISCLOSURE OF THE INVENTION

The inventors carried out studies to solve the above-described problems, and studied, as the basis of the method of introducing an oxide into a matrix metal, a method in which alloy powder or an alloy wire rod of the matrix metal and an additive metal is used to oxidize the additive metal in the alloy, which is the latter method of the before-mentioned conventional art. We attached great importance to the uniform dispersion of oxide. As a result, as a method in which oxidizing reaction of additive metal in the alloy can be allowed to proceed without heating of the additive metal at high temperatures, we found a method in which the alloy is agitated by a high-energy ball mill in water, by which the alloy is oxidized with water (oxygen which constitutes water).

The powder or wire rod agitated in the high-energy ball mill repeats pulverization (segmentalization), compression, and adhesion on receipt of the shock of high energy. In this process, when the powder or wire rod is pulverized (segmentalized), a new surface is exposed. It can be said that this new surface is active and in a state of being liable of oxidizing. Therefore, by making this agitation in a water atmosphere, the exposed new surface of alloy is oxidized by water.

The above-described reaction caused by the agitation in the high-energy ball mill can proceed without high temperatures. Therefore, since the alloy can be oxidized at ordinary temperature, the problem of grain growth is less prone to arise, and thus an oxide in an ideal state can be dispersed uniformly.

That is to say, the present invention provides a manufacturing method for an oxide-dispersed alloy in which dispersed particles consisting of metal oxides of one or two or more kinds of additive metals are dispersed in a matrix metal, and this method includes the following steps:

(a) A step of manufacturing alloy powder or an alloy wire rod consisting of the matrix metal and the additive metal;

(b) A step of oxidizing the additive metal in the alloy powder by water to form dispersed particles by introducing the alloy powder or alloy wire rod into a high-energy ball mill with water and by making agitation; and (c) A step of moldedly solidifying the alloy powder or alloy wire rod after oxidation.

Hereunder, the present invention is explained in more detail. In the present invention, alloy powder or an alloy wire rod consisting of a matrix metal and an additive metal is first manufactured. As a manufacturing method for the alloy powder, in addition to the atomization process (gas atomization, water atomization) in which molten alloy having a predetermined composition is used as a raw material, the rotational electrode process or the like in which an alloy lump manufactured via casting is used as a raw material can be applied. Of these processes, the atomization process is preferable. The reason for this is that powder can be obtained while the alloy state is kept without oxidizing the additive metal. The alloy powder manufactured here preferably has a particle diameter of 300 μm or smaller. If the particle diameter increases, the later oxidizing step using an attritor takes long time.

Also, the alloy wire rod is manufactured via the wire drawing, drawing, etc. of the cast alloy lump. The wire rod may be cut appropriately in order for the wire rod to be introduced into a high-energy ball mill.

After the alloy powder or alloy wire rod has been manufactured, the alloy powder or alloy wire rod is introduced into the high-energy ball mill with water and agitation is made to oxidize the additive metal in the alloy powder. The high-energy ball mill is a device in which a vessel is filled with steel balls or ceramic balls, which are grinding media, and further an agitating blade is provided in the vessel. As the high-energy ball mill, Dyno®-mill and Ultra Visco Mill (trade name) are known in addition to attritor. Dyno®-mill is manufactured by Willy A. Bachofen AG of Basel, Switzerland. Ultra ViscoMill (trade name) is manufactured by Aimex Co., Ltd. of Tokyo, Japan.

The construction material of the high-energy ball mill must be selected considering contamination due to the construction material of the high-energy ball mill caused by the high-energy agitation. In the present invention, ceramic is preferable, and in particular, zirconia is preferable. The reason for this is that immixing of construction material is less liable to occur, and even if immixing occurs, the influence on the material properties is the least. Also, the diameter of grinding medium is preferably 1 to 10 mm. If the diameter is smaller than 1 mm, it is necessary to rotate the agitating blade at a high speed to compensate the decrease in grinding force, and also it is difficult to separate the powder from the grinding medium after oxidation processing. If the diameter is larger than 10 mm, the torque required for rotation increases excessively, so that the vessel and the agitating blade are liable to be damaged. The fill of the grinding medium is preferably set so as to be 50% of vessel capacity, which is a general guideline. Unless this value is exceeded excessively, a harmful influence is less liable to be exerted.

The water introduced into the high-energy ball mill together with the alloy is preferably highly pure, and in particular, ultrapure water is preferable. In the case where oxidation processing is performed by using water containing impurities, the impurities adhere to the powder, and the adhering impurities are entrained in the oxide-dispersed alloy. The alloy containing impurities is a cause for gas generation at the time of use at high temperatures, so that there is a fear of causing strength degradation. The water is preferably introduced to a degree such that the powder is immersed. The reason for this is that the active new surface produced by high-energy agitation using the high-energy ball mill comes surely into contact with the water. The atmosphere in the vessel may be air; however, an oxygen atmosphere is preferably. The reason for this is that nitrogen in the air is prevented from being contained in the material.

The alloy powder having been subjected to oxidation processing using the high-energy ball mill can be made a bulk-form alloy by molded solidification processing. The molded solidification processing is preferably performed by a method of sintering the alloy powder while the alloy powder is pressurized as in the case of hot press. The conditions of hot press are preferably a temperature of 700 to 1300° C. and a press pressure of 10 MPa or higher. Also, in order to prevent the oxidation of alloy, the atmosphere of hot press is preferably a vacuum atmosphere. Before the molded solidification processing, the alloy powder may preliminarily be sintered temporarily.

For the alloy obtained by the molded solidification processing, the percent compaction thereof can be improved by forging. Also, in order to fabricate the alloy into a predetermined shape, plastic forming such as rolling, extruding, and drawing can be performed. Also, heat treatment can be carried out for the plastic forming.

In the present invention, the oxidation processing of dispersed particles is performed by the agitation in the high-energy ball mill. However, oxidation processing in which the alloy powder is further heated in an oxidizing atmosphere may be performed subsequently. The purpose for this is that in the case where all of the additive metal in the alloy powder is not oxidized in the oxidation processing using the high-energy ball mill, the oxidation of additive metal is carried out supplementally by performing heating processing subsequently, by which the quantity of oxide is increased. However, even if the oxidation processing using the high-energy ball mill is partial, the strength of alloy can be secured if necessary quantities of dispersed particles are formed. Therefore, the supplementary oxidation processing is not necessarily required. The condition in the case where oxidation processing by heating is performed is preferably a temperature of 700 to 1300° C. The reason for this is that at a temperature lower than 700° C., slow progress of oxidation requires long-term processing, and at a temperature higher than 1300° C., excessive growth of oxide-dispersed particles takes place.

The method in accordance with the present invention is effective in the case of the manufacture of an oxide-dispersed alloy of a combination of a metal in which the free energy of oxide formation thereof is higher than water standard free energy of formation, which is used as a matrix metal, and a metal in which the free energy of oxide formation thereof is lower than water standard free energy of formation, which is used as an additive metal. As explained above, in the present invention, since the dispersed particles are formed by the oxidizing reaction with water, in order to oxidize the additive metal in the alloy powder selectively, the above-described relationship is preferably provided.

For the combination that provides such a relationship, as the matrix metal, gold, silver, platinum, palladium, iridium, rhodium, and ruthenium can be cited. Also, as the additive metal, titanium, zirconium, hafnium, scandium, yttrium, magnesium, calcium, strontium, barium, aluminum, silicon, lanthanum, cerium, praseodymium, neodymium, samarium, europium, gadolinium, terbium, dysprosium, and holmium can be cited.

The matrix metal may consist of one kind of metal or may be an alloy of two or more metals. Also, the additive metal is not limited to one kind, and a platinum alloy in which the oxides of two or more additive metals are dispersed can be manufactured. In this case, if the plurality of kinds of additive metals have the above-described relationship, the oxidizing reaction of these metals can take place easily.

BEST MODE FOR CARRYING OUT THE INVENTION

A preferred embodiment of the present invention will now be described. In this embodiment, an oxide-dispersed alloy in which zirconium oxide (zirconia) particles are dispersed in platinum, which is a matrix metal, was manufactured.

Figure 1:
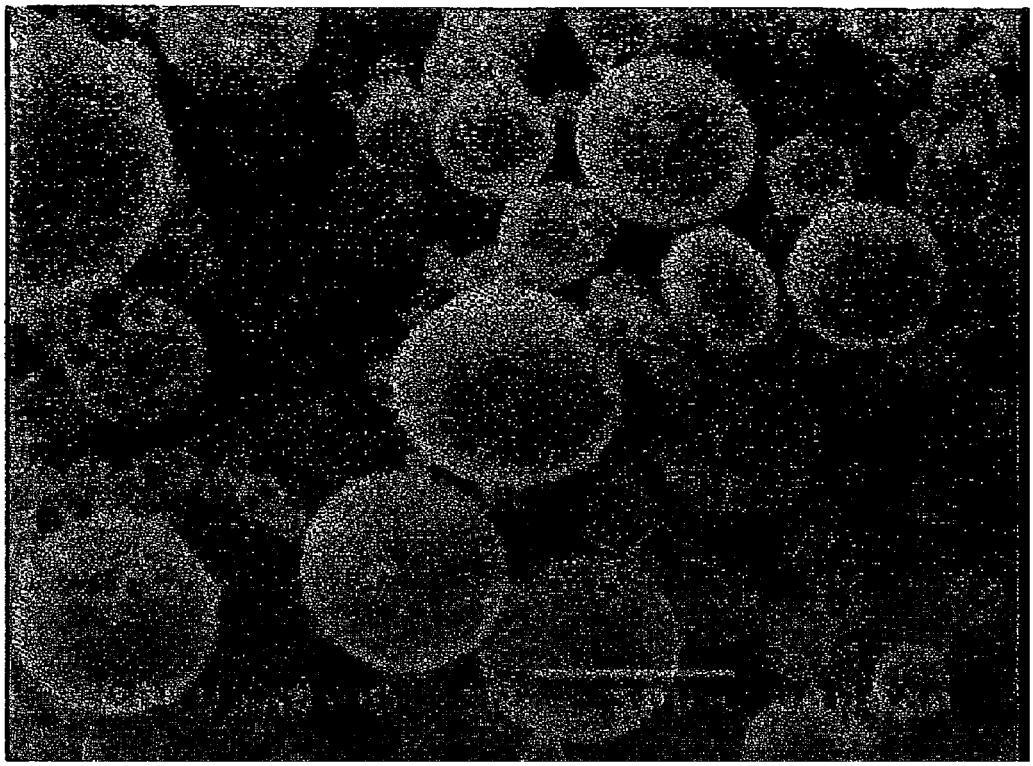
FIG. 1 is a photograph showing an SEM image of platinum-zirconia alloy powder manufactured by the atomization process in an embodiment of the present invention.

First, a platinum −0.3 wt % zirconium alloy was manufactured by vacuum melting, and the molten metal of this alloy was gas-atomized in an argon atmosphere to manufacture platinum-zirconium alloy powder. The conditions of atomization were a spray temperature of 2000° C. and a gas pressure of 40 kPa. At this time, the alloy powder had an average particle diameter of about 40 μm. FIG. 1 shows a SEM image of the alloy powder. As seen from FIG. 1, the alloy powder manufactured in this embodiment has a substantially spherical shape.

Figure 2:
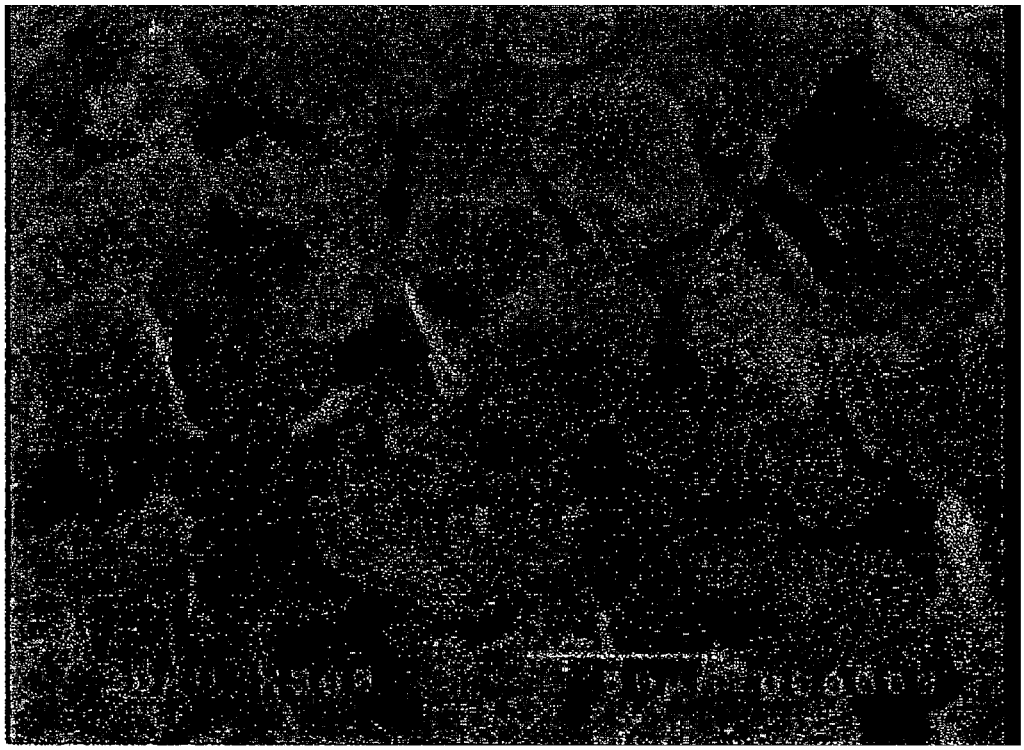
FIG. 2 is a photograph showing a SEM image of alloy powder after agitation processing using an attritor has been performed in an embodiment of the present invention.

Next, 3000 g of this alloy powder was introduced into an attritor (200 mm in inside diameter×185 mm in height, zirconia-made vessel+zirconia-coated stainless steel made agitating blade), which was a high-energy ball mill. At this time, 7 kg of zirconia balls each having a diameter of 5 mm and 1.0 L of ultrapure water were introduced at the same time. Then, the agitating blade of attritor was rotated at 340 rpm for 11 hours for agitation to oxidize the alloy powder. FIG. 2 shows the shape of alloy powder after being agitated. By the agitation processing using the attritor, the spherical alloy powder was subjected to repeated deformation and adhesion, and resultantly came to have an amorphous shape.

After the oxidation processing, the alloy powder is taken out. Of the alloy powder, 1603 g of the powder was charged into a die, and was sintered temporarily by being heated at 1200° C. for one hour in an atmosphere of $1.5\times10^{-2}$ Pa. The sintered alloy measured 40 mm×40 mm×135 mm, and had a density of 7.42 g/cm$^3$ and a percent compaction of 34.6%.

The temporarily sintered alloy was moldedly solidified via a hot press. At this time, the press temperature was set at 1200° C., and the press pressure was set at 6.5 tons. Also, the atmosphere was a vacuum atmosphere of $1.5\times10^{-2}$ Pa, and the press time was one hour. As a result, an alloy compact measuring 40.34 mm×40.45 mm×60.53 mm and having a density of 16.23 g/cm$^3$ and a percent compaction of 75.6% was obtained.

In order to further improve the percent compaction, the compact was hot forged at a temperature of 1300° C. The forged alloy measured 65 mm×65 mm×18 mm, and had a percent compaction of about 100%. Finally, this alloy was cold rolled so as to have a thickness of 4 mm, and was annealed for heat treatment (1250° C.×30 min). Further, the alloy was cold rolled until the thickness thereof became 0.8 mm. Thereby, a sheet of platinum-zirconium dispersed alloy was obtained.

Figure 3:
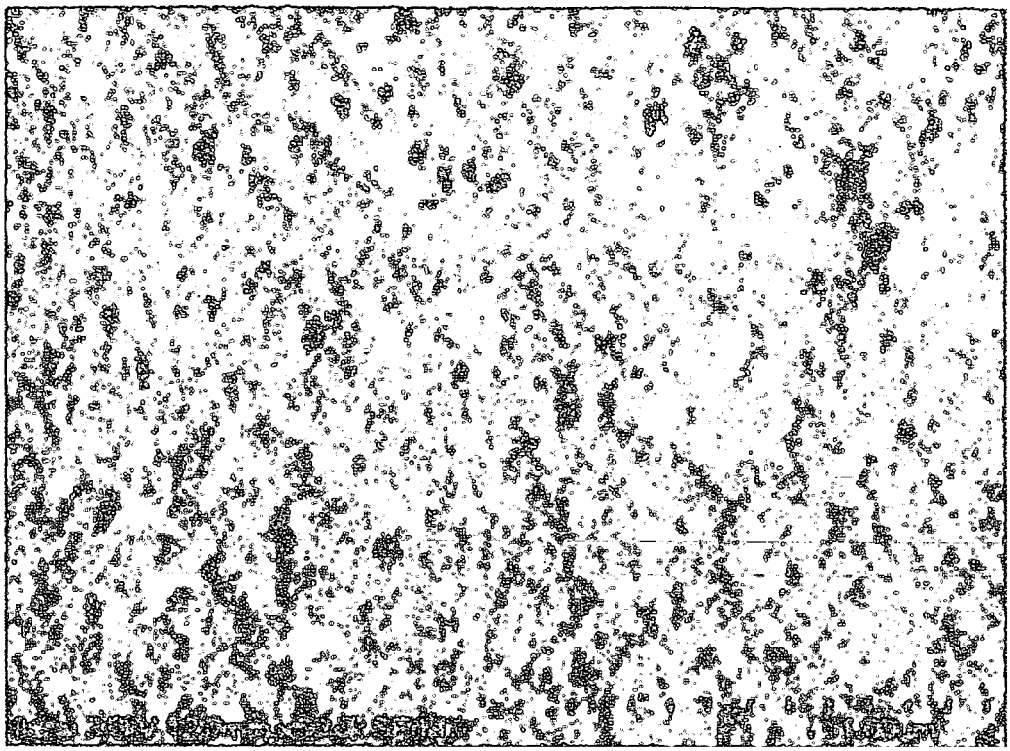
FIG. 3 is a photograph showing dispersed particles obtained by being filtrated after a platinum alloy manufactured in an embodiment of the present invention has been dissolved in aqua regia.
Figure 4:
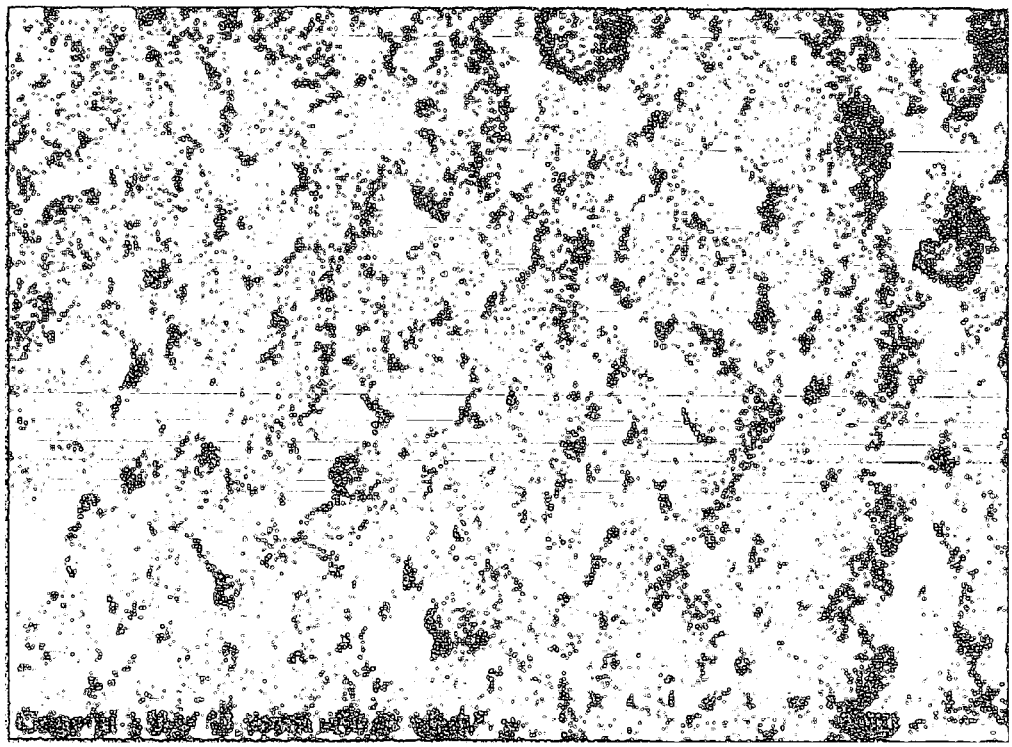
FIG. 4 is a photograph showing dispersed particles obtained by being filtrated after a conventional platinum alloy has been dissolved in aqua regia.

To check the particle diameter and dispersion state of dispersed particles of the alloy manufactured as described above, the alloy was immersed in aqua regia (temperature: 80° C.) to dissolve platinum, which was a parent material, and thereafter the dispersed particles were filtrated for purposes of surface observation. FIG. 3 shows the result of surface observation. FIG. 4 shows the result of the same processing of a conventional platinum-zirconia dispersed alloy (manufactured by Tanaka Kikinzoku Kogyo K.K.).

Comparing FIG. 3 and FIG. 4, the particle diameter of zirconia particles of the platinum alloy in accordance with this embodiment shown in FIG. 3 is estimated to be 0.02 μm or smaller, whereas the particle diameter of zirconia particles of the conventional platinum alloy shown in FIG. 4 is 0.2 μm. Thus, it could be verified that the dispersed particles in the oxide-dispersed alloy manufactured in this embodiment were very fine. Also, the average particle-to-particle distance of each alloy was calculated by regular tetrahedron conversion (dispersed particles are arranged at the apexes of a regular tetrahedron). As a result, the average particle-to-particle distance of the platinum alloy in accordance with this embodiment was estimated to be 0.190 μm, whereas the average particle-to-particle distance of the conventional platinum alloy was estimated to be 1.05 μm. Thus, it could be verified that in the platinum alloy in accordance with this embodiment, finer oxide particles were dispersed densely.

Figure 5:
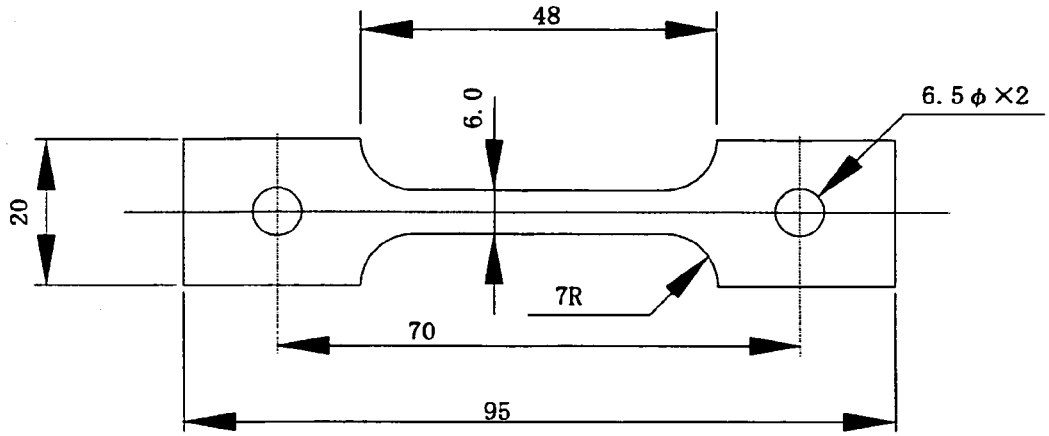
FIG. 5 is a view showing a shape of a sample used for a creep rupture test in an embodiment of the present invention.

Next, the platinum alloy (thickness: 0.8 mm) manufactured in this embodiment was pressed to prepare two creep test samples shown in FIG. 5. A creep rupture test was conducted under conditions of 1400° C. and 20 MPa, and the breaking strength was measured. The measurement result was that neither of the two samples got broken even when 350 hours had elapsed.

INDUSTRIAL APPLICABILITY

According to the method in accordance with the present invention, there can be manufactured an oxide-dispersed alloy having an ideal dispersion state, in which necessary minimum amounts of fine dispersed particles are dispersed uniformly.

The invention claimed is:

1. A manufacturing method for an oxide-dispersed alloy in which dispersed particles comprising oxides of one or two or more kinds of additive metals are dispersed in a matrix metal, comprising the steps of:

(a) manufacturing an alloy powder or an alloy wire rod comprising a matrix metal and an additive metal;

(b) oxidizing the additive metal in the alloy powder or alloy wire rod with water to form dispersed particles by introducing the alloy powder or alloy wire rod into an attritor with water, and by agitating the alloy powder or alloy wire rod therein; and (c) solidifying the alloy powder or alloy wire rod via heat and pressure, after oxidation;

wherein the matrix metal consists of one or two or more metals of gold, silver, platinum, palladium, iridium, rhodium, and ruthenium, and the additive metal is titanium, zirconium, hafnium, scandium, yttrium, magnesium, calcium, strontium, barium, aluminum, silicon, lanthanum, cerium, praseodymium, neodymium, samarium, europium, gadolinium, terbium, dysprosium, or holmium.

2. The manufacturing method for an oxide-dispersed alloy according to claim 1, wherein the water introduced into the attritor in step (b) is ultrapure water.

3. The manufacturing method for an oxide-dispersed alloy according to claim 2, wherein the alloy solidified via heat and pressure in step (c) is subjected to plastic forming of at least any of forging, rolling, extruding, and drawing.

4. The manufacturing method for an oxide-dispersed alloy according to claim 3, wherein the matrix metal is a metal in which the free energy of oxide formation thereof is higher than water standard free energy of formation, and the additive metal is a metal in which the free energy of oxide formation thereof is lower than water standard free energy of formation.

5. The manufacturing method for an oxide-dispersed alloy according to claim 2, wherein the matrix metal is a metal in which the free energy of oxide formation thereof is higher than water standard free energy of formation, and the additive metal is a metal in which the free energy of oxide formation thereof is lower than water standard free energy of formation.

6. The manufacturing method for an oxide-dispersed alloy according to claim 1, wherein the alloy solidified via heat and pressure in step (c) is subjected to plastic forming of at least any of forging, rolling, extruding, and drawing.

7. The manufacturing method for an oxide-dispersed alloy according to claim 6, wherein the matrix metal is a metal in which the free energy of oxide formation thereof is higher than water standard free energy of formation, and the additive metal is a metal in which the free energy of oxide formation thereof is lower than water standard free energy of formation.

8. The manufacturing method for an oxide-dispersed alloy according to claim 1, wherein the matrix metal is a metal in which the free energy of oxide formation thereof is higher than water standard free energy of formation, and the additive metal is a metal in which the free energy of oxide formation thereof is lower than water standard free energy of formation.

* * * * *